US009841156B2

(12) United States Patent
Ding

(10) Patent No.: US 9,841,156 B2
(45) Date of Patent: Dec. 12, 2017

(54) FLICKERING ELECTRONIC CANDLE

(71) Applicant: Nantong Ya Tai Candle Arts & Crafts Co., Ltd., Nantong, Jiangsu Province (CN)

(72) Inventor: Yingqi Ding, Nantong (CN)

(73) Assignee: Nantong Ya Tai Candle Arts & Crafts Co., Ltd., Nantong, Jiangsu (CN)

( * ) Notice: Subject to any disclaimer, the term of this patent is extended or adjusted under 35 U.S.C. 154(b) by 131 days.

(21) Appl. No.: 14/957,538

(22) Filed: Dec. 2, 2015

(65) Prior Publication Data

US 2017/0122511 A1 May 4, 2017

(30) Foreign Application Priority Data

Oct. 30, 2015 (CN) ..... 2015 2 0864236 U

(51) Int. Cl.
*F21S 10/04* (2006.01)
*F21S 6/00* (2006.01)
*F21Y 101/00* (2016.01)

(52) U.S. Cl.
CPC ..... *F21S 10/046* (2013.01); *F21S 6/001* (2013.01); *F21Y 2101/00* (2013.01)

(58) Field of Classification Search
CPC ..... F21S 6/001; F21S 10/04; F21S 10/046; F21V 35/00; F21V 35/003
USPC ..... 362/810, 386, 569
See application file for complete search history.

(56) References Cited

U.S. PATENT DOCUMENTS 5,658,073 A * 8/1997 Lee ..... F21S 6/001 362/392
6,935,762 B2 * 8/2005 Van Dyn Hoven ..... F21S 6/001 362/236
8,556,476 B2 10/2013 Ding
8,585,234 B2 11/2013 Ding
9,074,741 B2 7/2015 Ding
2007/0236948 A1 * 10/2007 Restell ..... C11C 5/008 362/392
2012/0307517 A1 12/2012 Ding
2013/0258648 A1 * 10/2013 Ding ..... F21S 6/001 362/190
2014/0211499 A1 * 7/2014 Fong ..... F21S 6/001 362/558
2014/0218903 A1 * 8/2014 Sheng ..... F21S 10/04 362/190
2015/0124442 A1 5/2015 Ding
(Continued)

*Primary Examiner* — William N Harris
(74) *Attorney, Agent, or Firm* — Loza & Loza, LLP; Michael F. Fedrick

(57) ABSTRACT

The present invention provides a flickering electronic candle, comprising a candle body, where the candle body comprises a first cylinder, a second cylinder connected with the first cylinder and a third cylinder connected with the second cylinder; a flickering candle wick movably arranged in the first cylinder through a support structure, with a flame front arranged at the top of the flickering candle wick and a magnet arranged at the bottom of the flickering candle wick; and a driving chip arranged in the second cylinder. The flame front is in a hollow flame shape, and an LED (Light Emitting Diode) bulb is further arranged in the flame front. A power unit is further arranged in the third cylinder, and the power unit is respectively connected with the driving chip and the LED bulb.

8 Claims, 4 Drawing Sheets

(56) References Cited

U.S. PATENT DOCUMENTS

| | | | | |
|---|---|---|---|---|
| 2015/0124474 | A1 | 5/2015 | Ding | |
| 2015/0233538 | A1* | 8/2015 | Sheng | F21S 10/046 362/190 |
| 2016/0290579 | A1* | 10/2016 | Au | F21S 10/046 |

* cited by examiner

FLICKERING ELECTRONIC CANDLE

CROSS-REFERENCE TO RELATED APPLICATIONS

This application claims the benefit of priority under 35 U.S.C. §119 from Chinese Patent Application No. 201520864236X, filed on Oct. 30, 2015. The disclosure of the foregoing application is incorporated herein by reference in its entirety.

FIELD OF THE INVENTION

The present invention relates to the field of electronic candles, and specifically relates to a flickering electronic candle.

BACKGROUND

Since electronic candles have been launched, they are favored by more and more people as they are safe in use, convenient, energy-saving and environment-friendly, particularly in the Occident, they gradually tend to replace traditional candles with open flame.

However, the existing electronic candles, which are mostly provided with luminous bodies, are not dynamic, do not have the feeling of flickering with wind and are not vivid enough. Or some candles with a flickering function are rough in manufacturing and relatively boring, moreover, flickering heads are easily blocked and are not flexible, the flickering angle range is small, and the fidelity is low.

SUMMARY

In view of the above defects in the prior art, it is expected to provide a flickering electronic candle.

The invention provides a flickering electronic candle, including a candle body, wherein the candle body includes a first cylinder, a second cylinder connected with the first cylinder and a third cylinder connected with the second cylinder; a flickering candle wick is movably arranged in the first cylinder through a support structure, a flame front is arranged at the top of the flickering candle wick, a magnet is arranged at the bottom of the flickering candle wick, the flame front is in a hollow flame shape, and an LED bulb is further arranged in the flame front; and a driving chip is arranged in the second cylinder, the driving chip is connected with the LED bulb, a power unit 11 is arranged in the third cylinder, and the power unit 11 is respectively connected with the driving chip and the LED bulb.

The flickering electronic candle provided in the invention adopts the hollow flame front, the LED bulb is placed in the flame front, and the flame front and the internal bulb swing together, so that the flickering effect of the candle is more vivid; meanwhile, the candle is provided with different interconnected cylinders, the heights of the cylinders can be changed, and then the height of the candle can be changed, so that the candle can be matched with various external shells and is variable in style.

DESCRIPTION

The present application will be further described in detail below in combination with the accompanying drawings and specific embodiments. It is to be understood that the specific embodiments described herein are merely used for interpreting the relevant invention, rather than limiting the invention. In addition, it should be further noted that, for the purpose of convenient description, only the parts related with the invention are shown in the accompanying drawings.

It should be noted that the embodiments in the present application and the features in the embodiments can be combined with one another without conflict. The present application will be described in detail below with reference to the accompanying drawings and the embodiments.

Figure 1:
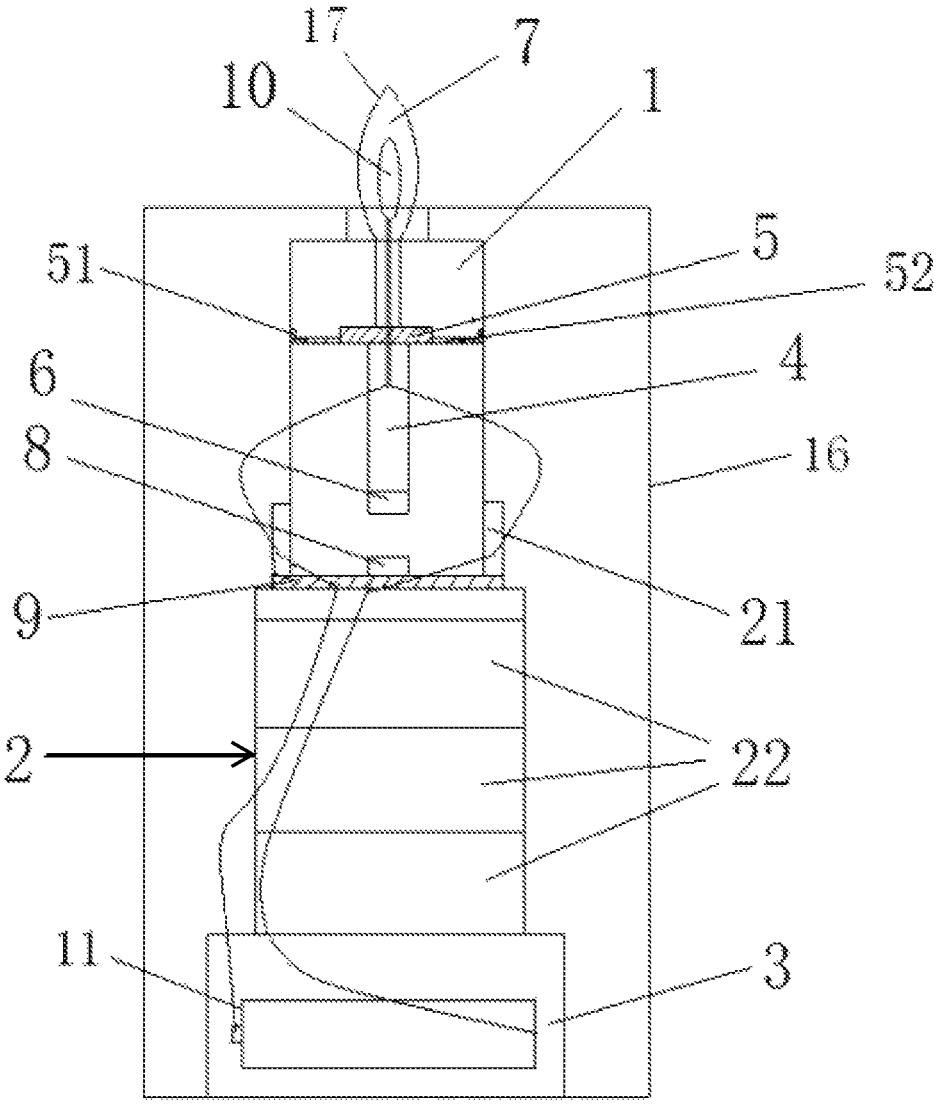
FIG. 1 is a schematic diagram of a structure of a flickering candle in one embodiment of the present invention.
Figure 2:
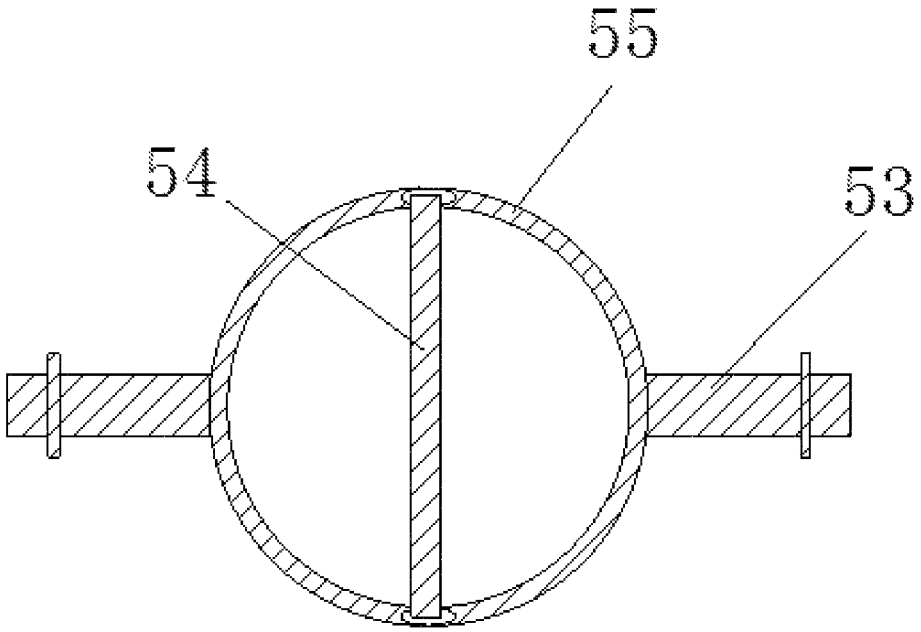
FIG. 2 is a top view of a support frame of the invention.
Figure 3:
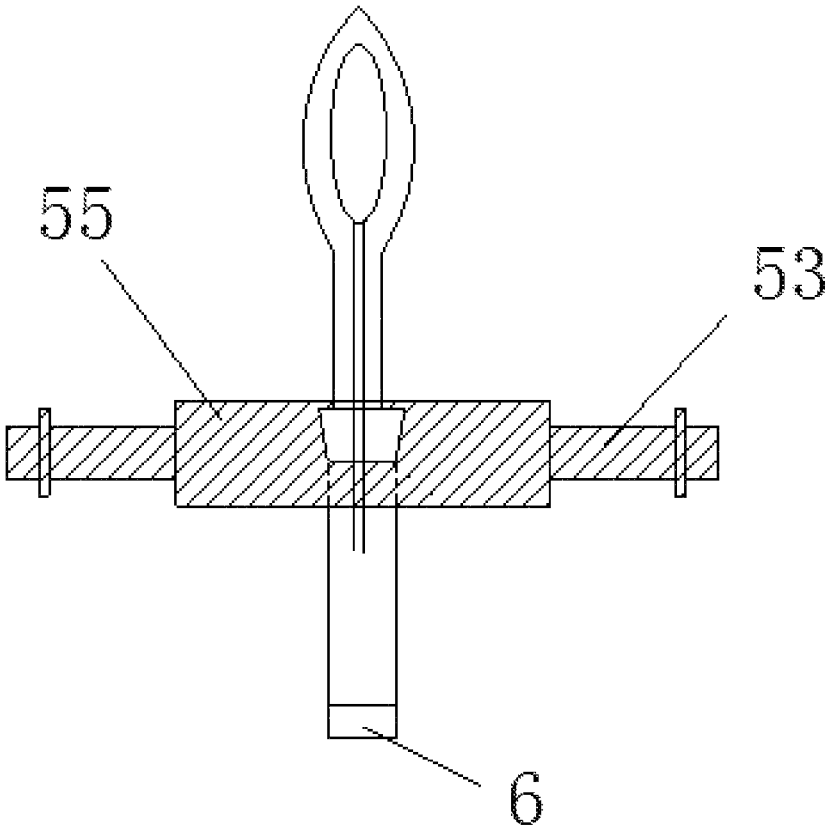
FIG. 3 is a front view of the support frame of the invention.
Figure 4:
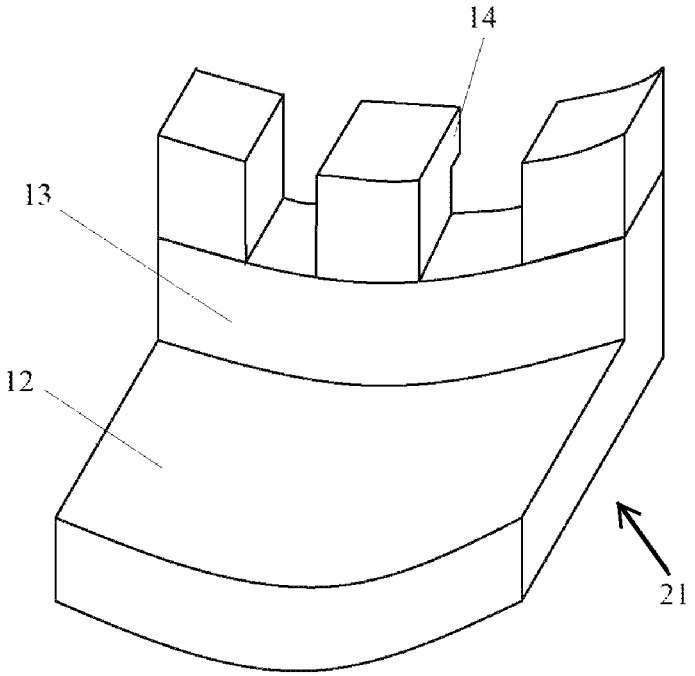
FIG. 4 is a perspective view of the first ferrule of FIG. 1.
Figure 5:
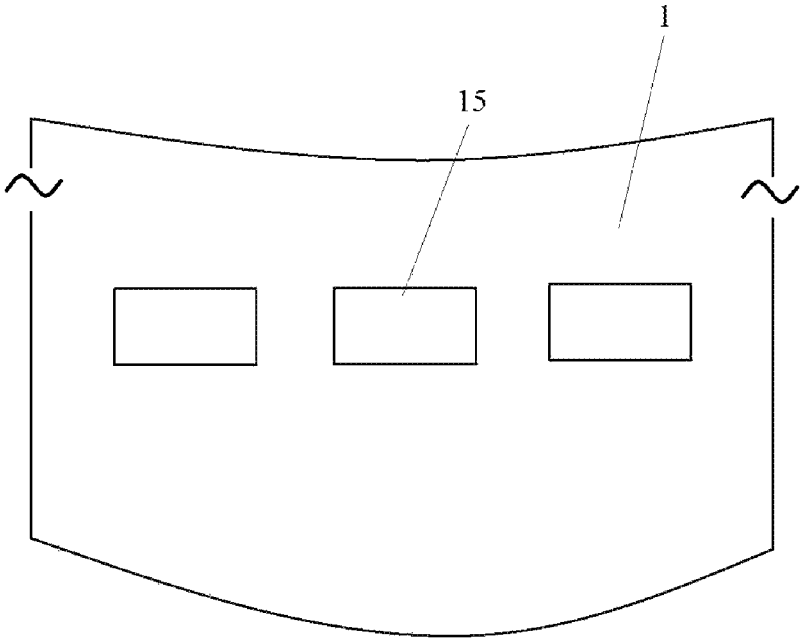
FIG. 5 is a partial, side plan view of the first cylinder of FIG. 1.

As shown in FIG. 1, the invention provides a flickering electronic candle, including a candle body, wherein the candle body includes a first cylinder 1, a second cylinder 2 connected with the first cylinder 1 and a third cylinder 3 connected with the second cylinder 2. A flickering candle wick 4 is movably arranged in the first cylinder 1 through a support structure 5, a flame front 7 is arranged at the top of the flickering candle wick 4, and a magnet 6 is arranged at the bottom of the flickering candle wick 4. The flame front 7 is preferably in a hollow flame shape, and an LED bulb 10 is arranged in the flame front 7. In addition, a driving chip 9 is arranged in the second cylinder 2, a power unit 11 is arranged in the third cylinder 3, and the power unit 11 is respectively connected with the driving chip 9 and the LED bulb 10.

The flickering candle provided by the present invention adopts the hollow flame front, the LED bulb is placed in the flame front, and the flame front and the internal bulb swing together, so that the flickering effect of the candle is more vivid; meanwhile, the candle is provided with different interconnected cylinders, the heights of the cylinders can be changed, and then the height of the candle can be changed, so that the candle can be matched with various external shells and is variable in style and high in ornamental value.

Preferably, the first cylinder 1 is clamped with the second cylinder 2, and the diameter of the second cylinder 2 is not smaller than that of the first cylinder 1; the third cylinder 3 is sleeved with the second cylinder 2, and the diameter of the third cylinder 3 is not smaller than that of the second cylinder 2.

The flickering candle wick 4 is arranged inside the first cylinder 1, the driving chip 9 is arranged inside the second cylinder 2, an electromagnetic coil 8 on the driving chip 9 generates an electromagnetic field after being electrified, and the force generated by mutual repulsion between the electromagnetic field and the magnetic field of the magnet 6 at the bottom of the flickering candle wick 4 enables the flickering candle wick to deviate and swing; after the swinging device deviates from the balance position under the magnetic force, the swinging device may be subjected to self gravity; when the gravity is greater than the magnetic force, the swinging device may swing back; and in this way, the swinging device ceaselessly swings under the interaction of the magnetic force and gravity. Meanwhile, the flame front also swings, to produce the visual effect similar to a candle flame flickering, so that the flickering electronic candle is very vivid.

Preferably, the second cylinder 2 sequentially includes a first ferrule 21 and a plurality of second ferrules 22 from top to bottom, wherein a raised platform 12 is formed on the first ferrule 21, two sides of the platform 12 are connected with vertical baffles 13, and the driving chip is arranged in the platform 12. A plurality of grooves 15 are formed in the lateral surface of the first cylinder 1, a clamping hook 14 is arranged at the top of each baffle 13, and the clamping hooks 14 are connected with the grooves 15 by cooperation.

The second cylinder 2 in the present invention is formed by sleeving the plurality of ferrules, so that the height of the candle can be selected according to actual demands.

Preferably, the driving chip 9 is specifically arranged below the flickering candle wick 4, the electromagnetic coil 8 is arranged on the driving chip 9, and the electromagnetic coil 8 is positioned below the magnet 6.

The second cylinder is connected with the first cylinder, wherein the magnetic field generated by electrifying the electromagnetic coil on the driving chip interacts with the magnetic field of the magnet in the flickering candle wick arranged in the first cylinder to generate a force; and in order that the flickering candle wick swings more stably and attractively, the magnet and the electromagnetic coil are arranged oppositely.

Preferably, the flame front is further wrapped by a case 17, such as a frosted silicon rubber case or a rubber case or a plastic case in the same shape. In order that the light of the LED bulb in the flame front is softer and more vivid, the flame front may be covered by the frosted silicon rubber case.

Preferably, the support structure 5 includes a support 51 and a support frame 52 movably hung on the support 51, the support frame 52 includes a large support shaft 53 and a small support shaft 54 which are crossed with each other, a hollow frame 55 is arranged in the middle of the large support shaft 53, the hollow frame 55 is used for supporting the small support shaft 54, two ends of the small support shaft 54 are movably supported by the hollow frame 55, two ends of the large support shaft 53 are movably hung on the support, and the flickering candle wick 4 is crossly connected with the small support shaft 54.

Preferably, an included angle of 90 degrees is formed between the large support shaft 53 and the small support shaft 54.

In the present invention, the support is supported by the hollow cylinder, the support frame is movably hung on the support, and the support frame supports the flickering candle wick; a gap for hanging and supporting the large support shaft is formed at the upper edge of the hollow cylinder, the support frame includes the large support shaft and the small support shaft which are crossed with each other and form an included angle of 90 degrees, the annular hollow frame is arranged in the middle of the large support shaft to support the small support shaft, two opposite holes are formed in the side walls of the annular hollow frame, the two ends of the small support shaft penetrate through the holes and are movably supported, the two ends of the large support shaft are movably hung on the support, the flickering candle wick is crossly connected with the small support shaft, the flame front at the top of the flickering candle wick is positioned above the small support shaft, and the magnet arranged at the bottom of the flickering candle wick is positioned below the small support shaft. The first cylinder is further provided with a hole through which an electric wire penetrates to connect the LED bulb with a power supply.

Preferably, the outer part of the candle body is connected with a shell 16, and the shell 16 is cylindrical and lower than the candle body.

In the present invention, the shell 16 with different patterns is further preferably packaged outside the candle body, wherein the shell 16 is lower than the candle body to expose the flame front, so that flickering of the flame front can be clearly viewed during enjoying.

The above descriptions are merely used for describing the preferred embodiments of the present application and the applied technical principles. Those skilled in the art should understand that, the invention scope of the present application is not limited to the technical solutions formed by specific combinations of the above technical features, meanwhile, the invention scope of the present application also covers other technical solutions formed by random combinations of the above technical features or other equivalent features without departing from the invention conception, e.g., the technical solutions formed by mutual substitution of the above features and the technical features disclosed (but not limited to) in the present application and having similar functions.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

What is claimed is:

1. A flickering electronic candle, comprising:

a candle body, wherein the candle body comprises a first cylinder, a second cylinder connected with the first cylinder, and a third cylinder connected with the second cylinder;

a flickering candle wick movably arranged in the first cylinder through a support structure;

a flame front arranged at a top of the flickering candle wick, wherein the flame front is in a hollow flame shape and an LED bulb is arranged in the flame front;

a magnet arranged at a bottom of the flickering candle wick;

a driving chip arranged in the second cylinder;

a power unit arranged in the third cylinder, wherein the power unit is respectively connected with the driving chip and the LED bulb;

wherein the second cylinder sequentially comprises a first ferrule and a plurality of second ferrules from top to bottom, a raised platform is formed on the first ferrule, two sides of the platform are connected with vertical baffles, and the driving chip is arranged in the platform.

2. The flickering electronic candle of claim 1, wherein the first cylinder is clamped with the second cylinder, and a diameter of the second cylinder is not smaller than a diameter of the first cylinder; and wherein the third cylinder is sleeved with the second cylinder, and a diameter of the third cylinder is not smaller than the diameter of the second cylinder.

3. The flickering electronic candle of claim 1, wherein a plurality of grooves are formed in a lateral surface of the first cylinder, a clamping hook is arranged at a top of each baffle, and the clamping hooks are connected with the grooves by cooperation.

4. The flickering electronic candle of claim 1, wherein the driving chip is specifically arranged below the flickering candle wick, an electromagnetic coil is arranged on the driving chip, and the electromagnetic coil is positioned below the magnet.

5. The flickering electronic candle of claim 1, wherein the flame front is further wrapped with a frosted silicon rubber case, a rubber case, or a plastic case having a shape identical to that of the flame front.

6. The flickering electronic candle of claim 1, wherein the support structure comprises a support and a support frame movably hung on the support, the support frame comprises a large support shaft and a small support shaft which are crossed with each other, a hollow frame is arranged in the middle of the large support shaft, the hollow frame is used for supporting the small support shaft, two ends of the small support shaft are movably supported by the hollow frame, two ends of the large support shaft are movably hung on the support, and the flickering candle wick is crossly connected with the small support shaft.

7. The flickering electronic candle of claim 6, wherein an included angle of 90 degrees is formed between the large support shaft and the small support shaft.

8. The flickering electronic candle of claim 1, wherein an outer part of the candle body is connected with a shell, and the shell is cylindrical and lower than the candle body.

* * * * *